US008988469B2

(12) United States Patent
Kang et al.

(10) Patent No.: US 8,988,469 B2
(45) Date of Patent: Mar. 24, 2015

(54) IMAGE DISPLAY DEVICE AND DRIVING METHOD THEREOF

(75) Inventors: Dong Woo Kang, Goyang-si (KR); Jong Jin Park, Anyang-si (KR)

(73) Assignee: LG Display Co., Ltd., Seoul (KR)

( * ) Notice: Subject to any disclaimer, the term of this patent is extended or adjusted under 35 U.S.C. 154(b) by 562 days.

(21) Appl. No.: 12/967,700

(22) Filed: Dec. 14, 2010

(65) Prior Publication Data

US 2011/0157248 A1 Jun. 30, 2011

(30) Foreign Application Priority Data

Dec. 31, 2009 (KR) ..... 10-2009-0135082

(51) Int. Cl.
*G09G 5/10* (2006.01)
*G09G 3/36* (2006.01)
*G09G 3/34* (2006.01)

(52) U.S. Cl.
CPC ..... *G09G 3/3426* (2013.01); *G09G 2320/0646* (2013.01); *G09G 2330/021* (2013.01); *G09G 2360/16* (2013.01)
USPC ..... 345/690; 345/102; 345/98

(58) Field of Classification Search
USPC ..... 345/98–100, 102, 103, 690, 89
See application file for complete search history.

(56) References Cited

U.S. PATENT DOCUMENTS

| | | | | |
|---|---|---|---|---|
| 5,754,749 | A * | 5/1998 | Kimura | 358/1.18 |
| 2007/0152926 | A1 | 7/2007 | Kwon | |
| 2008/0055219 | A1* | 3/2008 | Jung et al. | 345/89 |
| 2009/0140665 | A1* | 6/2009 | Park | 315/291 |
| 2009/0184917 | A1 | 7/2009 | Park et al. | |
| 2009/0303171 | A1 | 12/2009 | Chang | |
| 2010/0007682 | A1* | 1/2010 | Kwon et al. | 345/690 |

FOREIGN PATENT DOCUMENTS

| | | |
|---|---|---|
| CN | 1997155 | 7/2007 |
| CN | 101127198 | 2/2008 |
| EP | 1 031 961 | 8/2000 |
| KR | 10-2008-0039718 | 5/2008 |
| KR | 10-2009-0081290 | 7/2009 |

* cited by examiner

*Primary Examiner* — Jimmy H Nguyen
(74) *Attorney, Agent, or Firm* — McKenna Long & Aldridge LLP

(57) ABSTRACT

Disclosed is an image display device and its driving method, which facilitates to improve partial luminance in an image-display area by a local dimming method to partially control a backlight unit according to a display image, and simultaneously to reduce power consumption.

15 Claims, 6 Drawing Sheets

IMAGE DISPLAY DEVICE AND DRIVING METHOD THEREOF

CROSS REFERENCE TO RELATED APPLICATIONS

This application claims the benefit of the Korean Patent Application No. 10-2009-0135082 filed on Dec. 31, 2009, which is hereby incorporated by reference as if fully set forth herein.

BACKGROUND OF THE INVENTION

1. Field of the Invention

The present invention relates to an image display device, and more particularly, to an image display device which facilitates to improve partial luminance in an image-display area by a local dimming method to partially control a backlight unit according to a display image, and simultaneously to reduce power consumption, and a driving method thereof.

2. Discussion of the Related Art

Generally, a liquid crystal display (LCD) device includes a liquid crystal display panel and a backlight unit, wherein the liquid crystal display panel is provided with plural liquid crystal cells arranged in a matrix-type configuration, and plural control switches for conversion of image data to be supplied to the plural liquid crystal cells. In this case, a transmittance of light emitted from the backlight unit is controlled in the liquid crystal display panel, whereby a desired image is displayed on a screen.

A related art backlight unit may be largely classified into a direct type and an edge type. In the direct type backlight unit, a light source is positioned at a rear side of a liquid crystal display panel, whereby the liquid crystal display panel is directly illuminated with light emitted from the light source. In the edge type backlight unit, a light source is positioned at one lateral side or both lateral sides of a liquid crystal display panel, whereby the liquid crystal display panel is illuminated with light emitted from the light source through the use of light-guiding plate. Especially, the direct type backlight unit can realize high luminance since the liquid crystal display panel is directly illuminated with light emitted from plural lamps, whereby the direct type backlight unit is chiefly used for a large-sized liquid crystal display device.

The related art backlight unit applies light with constant luminance to the liquid crystal display panel without regard to an image displayed on the liquid crystal display panel. Accordingly, since the constant luminance is maintained in the backlight unit without regard to the image displayed on the liquid crystal display panel, it is difficult to animatedly express an image with parts requiring high luminance, for example, explosion scene or flashlight scene. In addition, the continuous provision of the constant luminance causes the increase of power consumption.

SUMMARY OF THE INVENTION

Accordingly, the present invention is directed to an image display device and a driving method thereof that substantially obviates one or more problems due to limitations and disadvantages of the related art.

An advantage of the present invention is to provide an image display device and a driving method thereof, which facilitate to improve partial luminance in an image-display area by a local dimming method to partially control a backlight unit according to a display image, and simultaneously to reduce power consumption.

Another advantage of the present invention is to provide an image display device and a driving method thereof, which facilitates to allow various analysis algorithms by analyzing a display image in a system main body through the use of local dimming method, and simultaneously to reduce cost.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an image display device comprising a liquid crystal display panel with plural display blocks; a system main body for generating image data to be displayed on the liquid crystal display panel, and generating plural block dimming data, which is applied block-by-block, by analyzing block image data to be supplied to the plural display blocks; a backlight unit for emitting light to the plural display blocks; a backlight driver for driving the backlight unit; and a panel driving part for controlling the backlight driver based on the plural block dimming data supplied from the system main body, and displaying an image based on the image data supplied from the system main body on the liquid crystal display panel.

At this time, the system main body modulates the image data to include the plural block dimming data therein, and supplies the modulated image data to the panel driving part.

In another aspect of the present invention, there is provided an image display device comprising a liquid crystal display panel with plural display blocks; a backlight unit for emitting light to the plural display blocks; a backlight driver for driving the backlight unit; and a panel driving part for controlling the backlight driver by extracting plural block dimming data, or plural scanning data together with the plural block dimming data from externally-provided image data, and simultaneously displaying an image based on the image data on the liquid crystal display panel.

In another aspect of the present invention, there is provided an image display device comprising a system main body for providing image data to the liquid crystal display device by controlling a transmittance of light applied to plural display blocks from a backlight unit, wherein the system main body generates the image data to be displayed on the liquid crystal display device, analyzes block image data to be supplied to the plural display blocks, generates plural block dimming data for controlling the backlight unit, and supplies the generated plural block dimming data to the liquid crystal display device.

In a further aspect of the present invention, there is provided a method of driving an image display device including a liquid crystal display panel with plural display blocks, and a backlight unit for emitting light to the plural display blocks, comprising generating image data in a system main body, the image data to be displayed on the liquid crystal display panel, and generating plural block dimming data by analyzing the image data to be supplied to the plural display blocks, and irradiating the plural display blocks with light emitted from the backlight unit which is driven based on the plural block dimming data supplied from the system main body, and displaying an image based on the image data supplied from the system main body on the liquid crystal display panel.

In addition, the driving method further includes modulating the image data in the system main body so that the modulated image data includes the plural block dimming data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, an image display device according to the present invention and a driving method thereof will be described with reference to the accompanying drawings.

Figure 1:
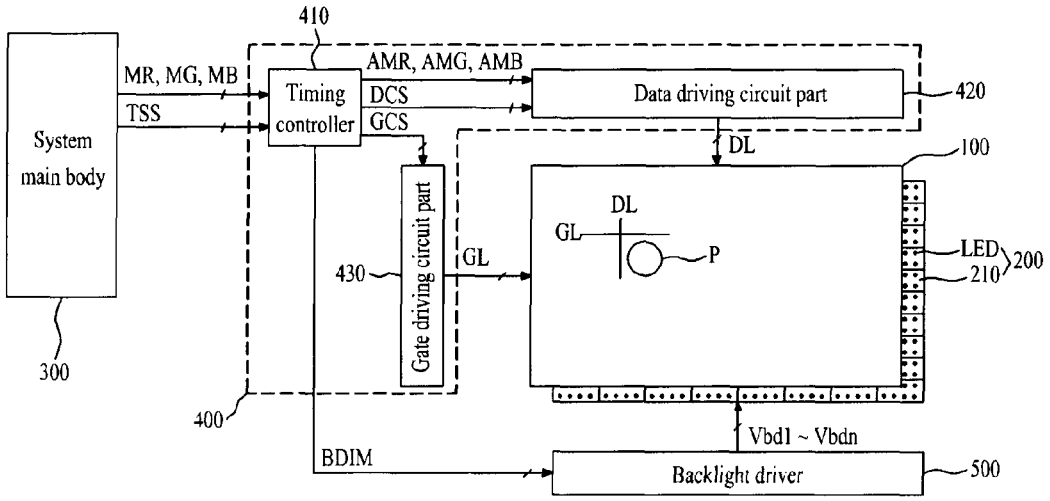
FIG. 1 illustrates an image display device according to the embodiment of the present invention.

FIG. 1 illustrates an image display device according to the embodiment of the present invention.

Referring to FIG. 1, the image display device according to the embodiment of the present invention includes a liquid crystal display panel 100, a backlight unit 200, a system main body 300, a panel driving part 400, and a backlight driver 500. Herein, the liquid crystal display panel 100, the backlight unit 200, the panel driving part 400, and the backlight driver 500 constitute a liquid crystal display device which displays an image by controlling a light transmittance according to image data provided from the system main body 300.

In the liquid crystal display panel 100, a plurality of gates lines GL and data lines DL are formed in such a way that the gate and data lines cross at right angles to each other, that is, are perpendicular to each other. Thus, pixel regions are defined by the gate lines GL and data lines DL crossing at right angles to each other, and pixels P are formed in the respective pixel regions.

Each of the plural pixels P includes a thin film transistor (not shown) connected to the gate line GL and data line DL; and a liquid crystal cell connected to the thin film transistor.

The thin film transistor supplies a data voltage supplied from the data line DL to the liquid crystal cell in response to a scan pulse supplied from the gate line GL.

The liquid crystal cell can be equivalently expressed as a liquid crystal capacitor (not shown) because it is provided with a common electrode facing via liquid crystal, and a pixel electrode connected to the thin film transistor. In addition, the liquid crystal cell comprises a storage capacitor (not shown) which maintains the data voltage charged on the liquid crystal capacitor (not shown) until the next data voltage is charged thereon.

As an electric field is formed in each pixel P of the liquid crystal display panel 100 through the use of scan pulse and data voltage supplied from the panel driving part 400, the liquid crystal display panel 100 can control the transmittance of light emitted from the backlight unit 200 through the electric field, to thereby display the image on the liquid crystal display panel 100.

The backlight unit 200 includes 'n' light-emitting diode arrays (hereinafter, referred to as 'LED arrays') 210 which are provided to confront 'n' display blocks on a rear surface of the liquid crystal display panel 100.

Each of the 'n' LED arrays 210 drives 'm' LEDs by each block dimming voltage Vbd1 to Vbdn supplied from the backlight driver 500, wherein the block dimming voltage Vbd1 to Vbdn is applied block-by-block, whereby the rear surface of the liquid crystal display panel 10 is irradiated with light. In this case, since the 'n' LED arrays 210 are respectively arranged in the 'n' display blocks divided on the rear surface of the liquid crystal display panel 100, the liquid crystal display panel 100 is divided into 'n' display blocks, and the light is applied to each display block. Accordingly, the liquid crystal display panel 100 is divided into the 'n' display blocks to respectively confront the 'n' LED arrays 210. For example, the liquid crystal display panel 100 may be divided into 80 display blocks (10×8), but it is not limited to this. The number of display blocks may vary based on the size of the liquid crystal display panel 100 and/or the number of LED arrays 210.

Figure 2:
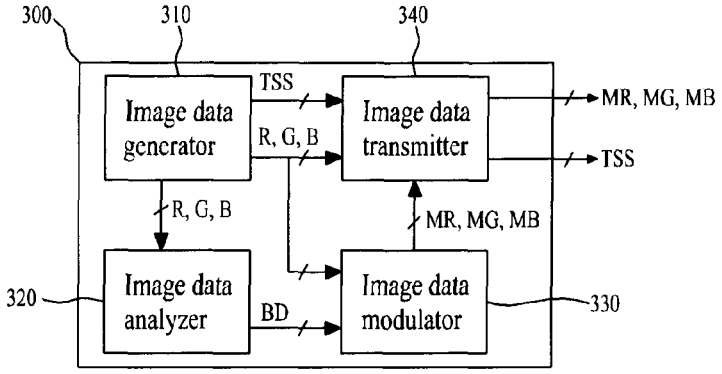
FIG. 2 illustrates a system main body in the image display device of FIG. 1.

The system main body 300 generates image data to be displayed on the liquid crystal display panel 100 including the 'n' display blocks; generates block dimming data, which is applied block-by-block, by analyzing the image data; and supplies the generated block dimming data to the panel driving part 400. For this, as shown in FIG. 2, the system main body 300 includes an image data generator 310, an image data analyzer 320, an image data modulator 330, and an image data transmitter 340.

The image data generator 310 generates the image data R, G, and B to be displayed on the liquid crystal display panel 100. Also, the image data generator 310 generates a timing synchronization signal TSS to display the image data R, G, and B on the liquid crystal display panel 100. At this time, the timing synchronization signal TSS may include a vertical synchronous signal Vsync, a horizontal synchronous signal Hsync, a data enable signal Data Enable, and a dot (or data) clock DCLK.

The image data analyzer 320 generates block dimming data BD, which is applied block-by-block, by analyzing the block image data to be supplied to the respective 'n' display blocks. At this time, the image data analyzer 320 generates the block dimming data BD by detecting luminance or grayscale of the image data to be supplied to each display block per frame. At this time, the block dimming data BD may be the largest grayscale value, the average grayscale value, the highest luminance value, or the average luminance value among the image data to be supplied to each display block, but it is not limited to these. For example, the block dimming data BD may be a mode value, which occurs most frequently in a histogram of the image data to be supplied to each display block.

The image data analyzer 320 is formed in the system main body 300 whose processing speed is relatively more rapid. Thus, the image data analyzer 320 can generate the aforementioned block dimming data BD by using various image analysis algorithms to be treated in the system main body 300.

Figure 3A:
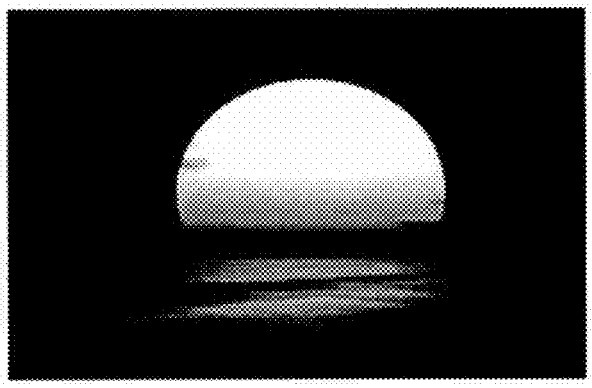
FIG. 3A illustrates a display image generated based on image data of FIG. 2.
Figure 3B:
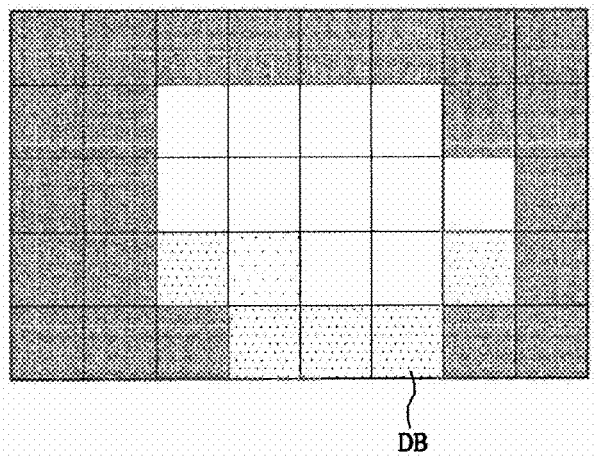
FIG. 3B illustrates a method of generating block dimming data for the display image of FIG. 3A in an image data analyzer of FIG. 2.

For example, when the image such as sunrise is displayed on the liquid crystal display panel 100, as shown in FIG. 3A, the image data analyzer 320 divides the display image into the 'n' display blocks DB; and generates the block dimming data BD by analyzing the image data of the display image corresponding to the respective display blocks through the aforementioned method, as shown in FIG. 3B.

The image data modulator 330 modulates the image data R, G, and B supplied from the image data generator 310, so that the modulated data includes the block dimming data BD supplied from the image data analyzer 320 therein. At this time, the image data modulator 330 can modulate some pieces of the image data R, G, and B to be supplied to the first horizontal line in each display block DB into the block dimming data BD. In order to minimize deterioration of picture quality by the modulation of image data R, G, and B, the image data modulator 330 can modulate the lowermost bit of each piece of the image data corresponding to a bit number of the block dimming data BD among the image data R, G, and B into the block dimming data BD.

Figure 4:
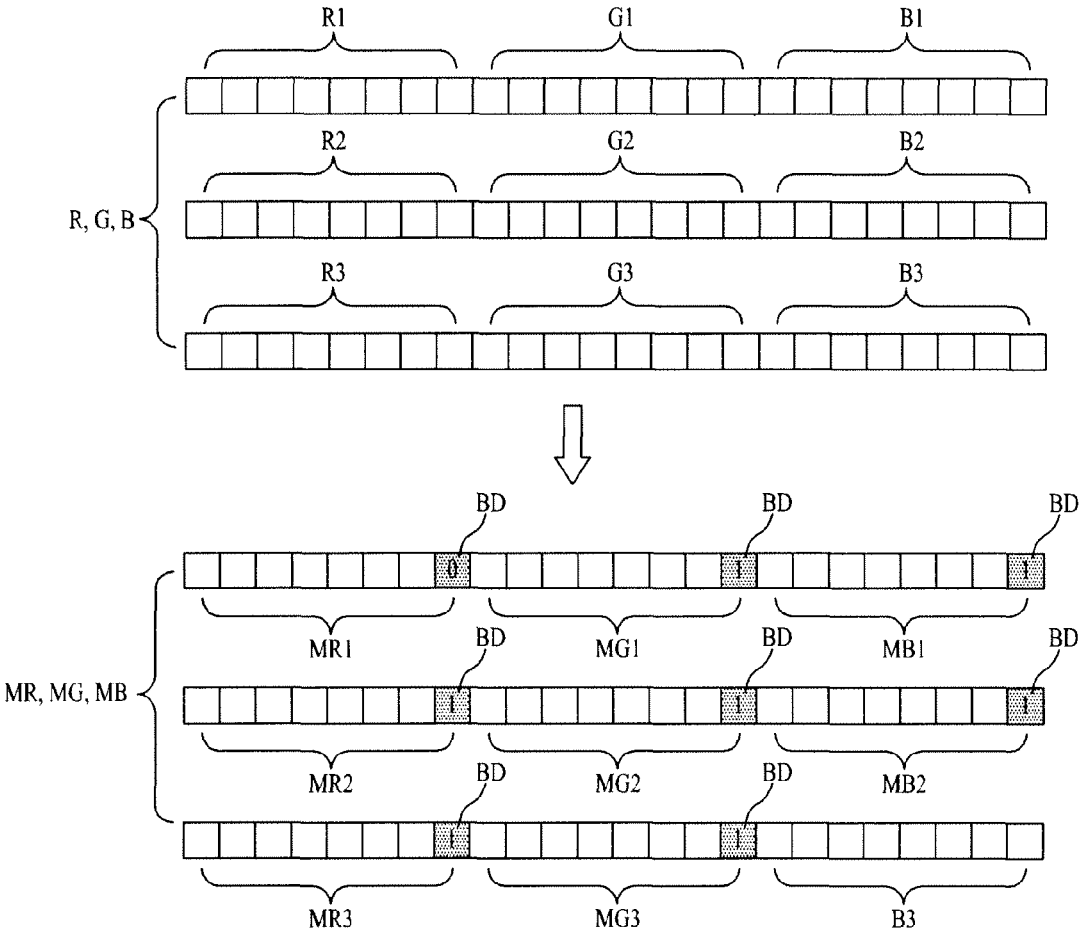
FIG. 4 illustrates a method of modulating image data according to one embodiment of the present invention in an image data modulator of FIG. 2.

For example, as shown in FIG. 4, if the first block dimming data among the block dimming data BD is 8 bits and its dimming data value '127', the image data modulator 330 modulates the lowermost bit value of each piece of the image data R1, G1, B1, R2, G2, B2, R3, G3, and B3 supplied to the first horizontal line of a first display block into "01111111", that is, the first block dimming data BD, to thereby generate the image data MR, MG, and MB including the first block dimming data BD.

Furthermore, the system main body 300 may generate scanning data to sequentially drive the 'n' LED arrays 210 according to the sequential driving of the horizontal rows of the plural display blocks; and may modulate the image data R, G, and B to include the generated scanning data and block dimming data BD therein. For minimizing the deterioration of picture quality according to the modulation of the image data R, G, and B, the image data modulator 330 can modulate both the lowermost bit of the image data corresponding to the bit number of the scanning data and the lowermost bit of the image data corresponding to the bit number of the block dimming data BD among the image data R, G, and B into the scanning data and the block dimming data BD, respectively. Preferably, the scanning data is positioned ahead of the block dimming data BD.

Figure 5:
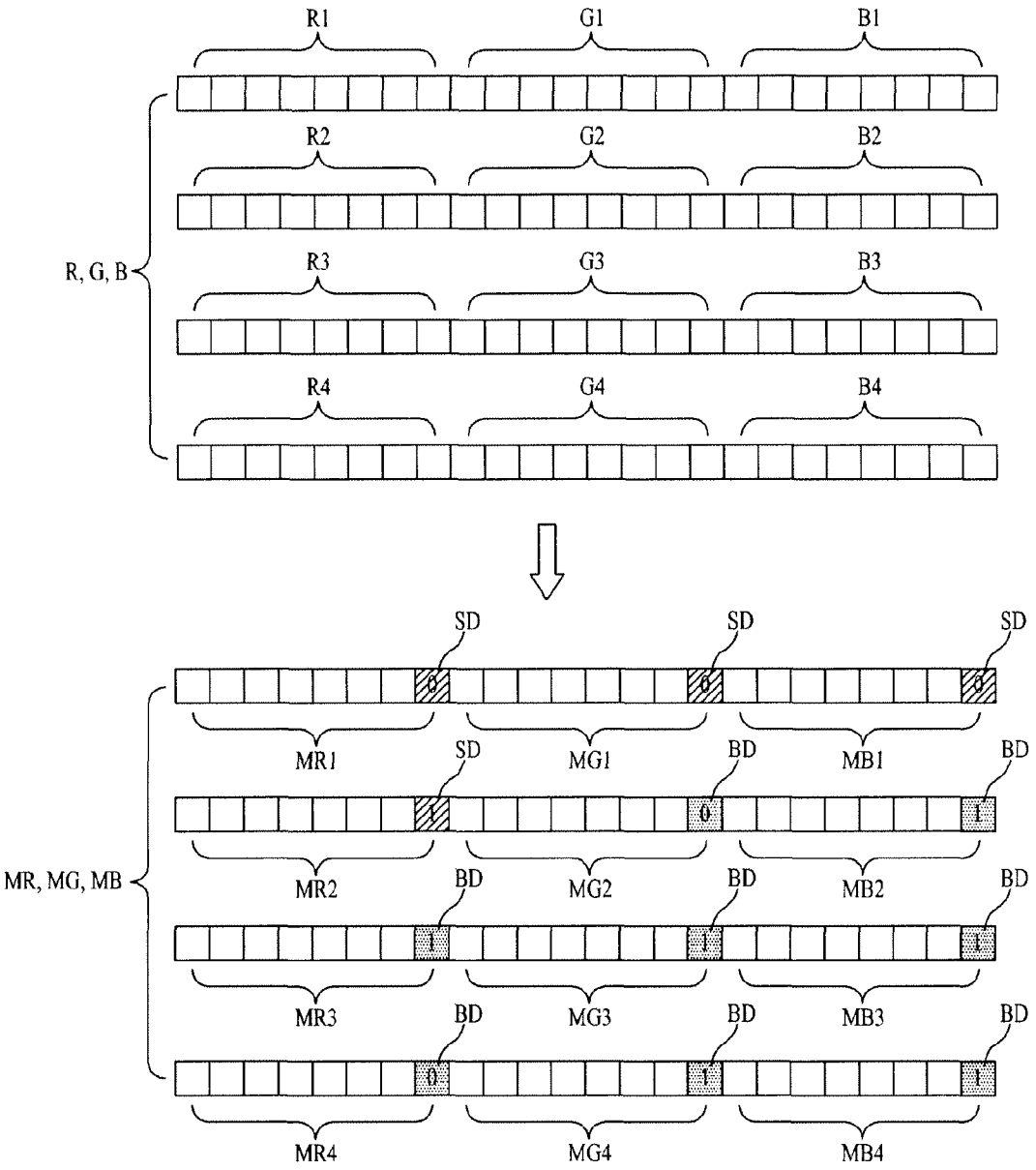
FIG. 5 illustrates a method of modulating image data according to another embodiment of the present invention in an image data modulator of FIG. 2.

For example, as shown in FIG. 5, if the scanning data is 8 bits and its data value '1', and the first block dimming data among the block dimming data BD is 8 bits and its dimming data value '127'; the image data modulator 330 modulates the lowermost bit value of each piece of the first to fourth image data R1, G1, B1, and R2 supplied to the first horizontal line into the scanning data "0001", and also modulates the lowermost bit value of each piece of the fifth to twelfth image data G2, B2, R3, G3, B3, R4, G4, and B4 into "01111111", that is, the first block dimming data BD, to thereby generate the image data MR, MG, and MB including the scanning data SD and block dimming data BD.

According to an interface method between the system main body 300 and the liquid crystal display device, the image data transmitter 340 transmits the image data MR, MG, and MB including the block dimming data BD supplied from the image data modulator 330 and the timing synchronization signal TSS supplied from the image data generator 310 to the panel driving part 400. For example, the image data transmitter 330 can transmit the image data MR, MG, and MB including the block dimming data BD to the panel driving part 400 by a low-voltage differential signal LVDS interface method.

If the image data R, G, and B is not modulated to include the aforementioned block dimming data BD therein, the image data transmitter 340 transmits each piece of the image data R, G, and B and block dimming data BD to the panel driving part 400 through an additional signal transmission cable (not shown) according to the interface method. However, if each piece of the image data R, G, and B and block dimming data BD is transmitted to the panel driving part 400, it is necessary to provide the additional signal transmission cable, whereby a manufacturing cost is increased due to the additional signal transmission cable. Preferably, the image data R, G, and B is modulated to include the block dimming data BD within a range of minimizing the deterioration of picture quality, and is then transmitted to the panel driving part 400. Supposing that the system main body 300 modulates the image data R, G, and B to include the block dimming data BD therein, and transmits the modulated image data to the panel driving part 400.

In FIG. 1, the panel driving part 400 controls the backlight driver 500 through the use of image data MR, MG, and MB including the block dimming data BD supplied from the system main body 300; and simultaneously displays the image based on the image data MR, MG, and MB on the liquid crystal display panel 100. For this, the panel driving part 400 includes a timing controller 410, a data driving circuit part 420, and a gate driving circuit part 430.

Figure 6:
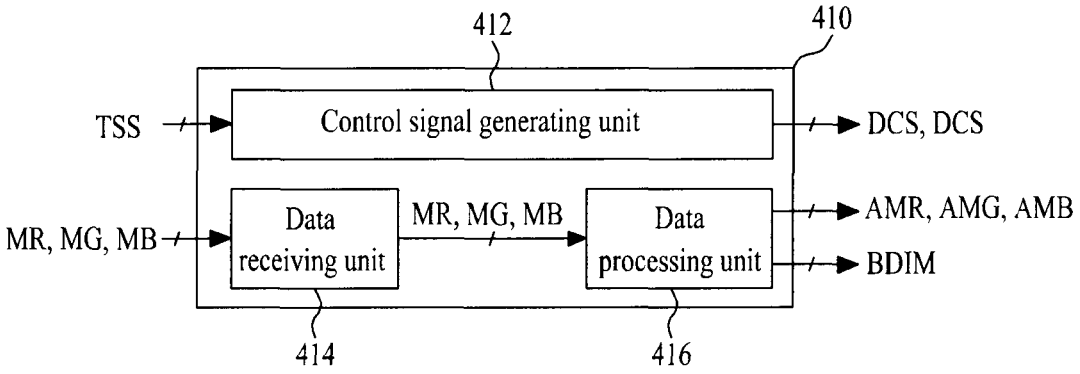
FIG. 6 illustrates a timing controller of FIG. 1.

As shown in FIG. 6, the timing controller 410 includes a control signal generating unit 412, a data receiving unit 414, and a data processing unit 416.

The control signal generating unit 412 generates a data control signal DCS for controlling a driving timing of the data driving circuit part 420, and simultaneously generates a gate control signal GCS for controlling a driving timing of the gate driving circuit part 430 through the use of timing synchronization signal TSS supplied from the system main body 300.

The data control signal DCS may be a source start pulse, a source sampling clock, a source output enable, a polarity control single POL, and etc.

The gate control signal GCS may be a gate start pulse, a gate shift clock, a gate output enable, and etc.

The data receiving unit 414 receives the image data MR, MG, and MB from the system main body 300 according to the interface method between the system main body 300 and the liquid crystal display device; and then supplies the received image data MR, MG, and MB to the data processing unit 416.

Figure 7:
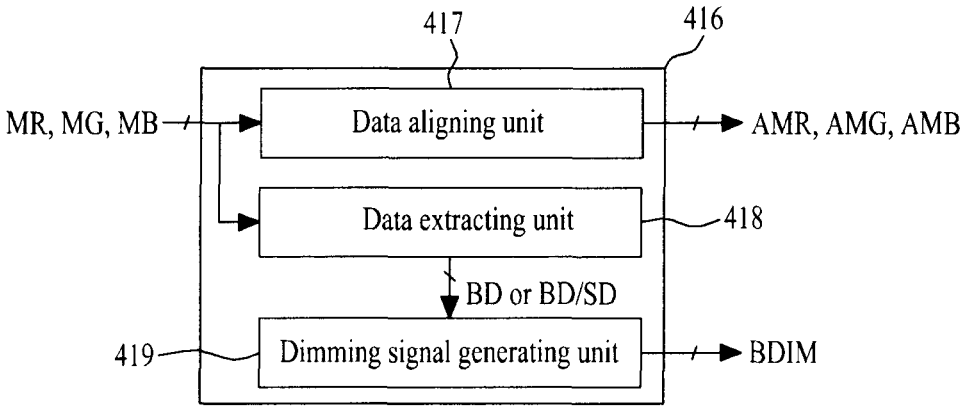
FIG. 7 illustrates a data processing unit of FIG. 6.

As shown in FIG. 7, the data processing unit 416 includes a data aligning unit 417, a data extracting unit 418, and a dimming signal generating unit 419.

The data aligning unit 417 aligns the image data AMR, AMG, and AMB supplied from the data receiving unit 414 so as to be proper for driving of the liquid crystal display panel 100, and then supplies the aligned image data to the data driving circuit part 420.

The data extracting unit 418 extracts only the block dimming data BD, or extracts the scanning data SD together with the block dimming data BD from the image data R, G, and B supplied from the data receiving unit 414; and then supplies the extracted data to the dimming signal generating unit 419.

Based on indicator and identifier, which are supplied ahead of the image data MR, MG, and MB supplied from the data receiving unit 414, the data extracting unit 418 checks whether or not the image data includes only the block dimming data BD, or the scanning data SD together with the block dimming data BD.

If it is determined that only the block dimming data BD is included in the image dada R, G, and B, the data extracting unit 418 extracts the lowermost bit of each piece of the image data MR, MG, and MB supplied after the indicator and identifier; and generates the block dimming data BD. For example, the data extracting unit 418 generates the block dimming data BD by extracting "01111111" from the lowermost bit value of each piece of the first to eight image data R1, G1, B1, R2, G2, B2, R3, and G3 shown in FIG. 4; and supplies the generated block dimming data BD to the dimming signal generating unit 419.

If it is determined that the scanning data SD together with the block dimming data BD is included in the image data MR, MG, and MB; the data extracting unit 418 extracts the lowermost bit of each piece of the image data MR, MG, and MB supplied after the indicator and identifier, and generates the scanning data SD and block dimming data BD. For example, the data extracting unit 418 generates the scanning data SD by extracting "0001" from the lowermost bit value of each piece of the first to fourth image data R1, G1, B1, and R2 shown in FIG. 5, and simultaneously generates the block dimming data BD by extracting "01111111" from the lowermost bit value of each piece of the fifth to twelfth image data G2, B2, R3, G3, B3, R4, G4, and B4; and supplies the generated scanning data SD and block dimming data BD to the dimming signal generating unit 419.

The dimming signal generating unit 419 generates a block dimming signal BDIM for driving the LED arrays 210 (See FIG. 1) corresponding to the respective display blocks based on the block dimming data, or the scanning data SD together with the block dimming data BD supplied from the data extracting unit 418; and supplies the generated block dimming signal BDIM to the backlight driver 500 (See FIG. 1).

In FIG. 1, the data driving circuit part 420 latches the image data MR, MG, and MB supplied from the timing controller 410 according to the data control signal DCS supplied from the timing controller 410; converts the latched image data into positive-polarity/negative-polarity analog data voltage through the use of analog positive-polarity/negative-polarity gamma voltage; generates a data voltage having a polarity corresponding to the polarity control signal POL; and supplies the generated data voltage to the data lines DL.

The gate driving circuit part 430 generates a scan pulse according to a gate control signal GCS supplied from the timing controller 410; and sequentially supplies the scan pulse to the gate lines GL. According as the gate driving circuit part 430 is formed on a substrate simultaneously with the thin film transistor, the gate driving circuit part 430 is formed in the liquid crystal display panel 100.

Figure 8:
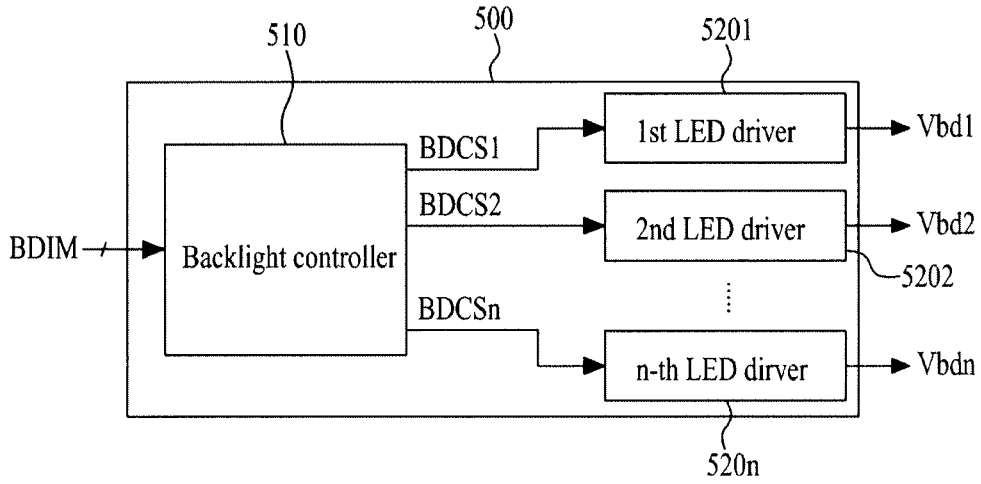
FIG. 8 illustrates a backlight driver of FIG. 1.

The backlight driver 500 generates the block dimming voltages Vbd1 to Vbdn corresponding to the block dimming signal BDIM supplied from the timing controller 410; and supplies the generated block dimming voltages to the backlight unit 200. For this, as shown in FIG. 8, the backlight driver 500 includes a backlight controller 510, and first to n-th LED drivers 5201 to 520*n*.

The backlight controller 510 generates 'n' block dimming control signals BDCS1 to BDCSn based on the block dimming signal BDIM supplied from the timing controller 410, wherein the number of block dimming control signals corresponds to the number of LED arrays 210.

The respective LED drivers of the first to n-th LED drivers 5201 to 520*n* generate the 'n' dimming voltages Vbd, that is, block dimming voltages Vbd1 to Vbdn for driving the respective LED arrays 210 according to the block dimming control signals BDCS1 to BDCSn supplied from the backlight controller 510; and supplies the generated block dimming voltages to the respective LED arrays 210. Accordingly, the respective LED arrays 210 are driven by the block dimming voltages Vbd1 to Vbdn respectively supplied from the first to n-th LED drivers 5201 to 520*n*, whereby the light emitted from the respective LED arrays 210 are supplied to the respective display blocks of the liquid crystal display panel 100.

In the liquid crystal display device according to the embodiment of the present invention and the driving method thereof, the block dimming data is generated in the system main body 300 through the analysis of block image data to be displayed on the liquid crystal display panel 100 with the plural display blocks; and the panel driving part 400 performs the local dimming based on the block dimming data, to thereby improve partial luminance of the display image, and simultaneously to reduce power consumption.

In the liquid crystal display device according to the embodiment of the present invention and the driving method thereof, the system main body 300 performs the analysis of display image for the local dimming; and also modulates the image data to include the block dimming data therein, and supplies the modulated image data to the panel driving part 400, whereby it allow various analysis algorithms simultaneously with reduction of cost.

In addition, the image data is modulated to include the block dimming data generated through the analysis of block image data, and then the modulated data is supplied to the panel driving part 400, whereby it is unnecessary to provide the additional signal transmission cable, to thereby result in the reduced cost.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An image display device comprising:

a liquid crystal display panel with plural display blocks;

a system main body for generating plural image data, generating plural block dimming data, which is applied block-by-block, by analyzing block image data supplied to the plural display blocks, and modulating the plural image data to include the plural block dimming data as the lowermost bit of the plural image data by replacing the lowermost bit of the plural image data with the block dimming data, to output plural modulated image data including the plural image data and the plural block dimming data;

a timing controller for aligning the plural modulated image data supplied from the system main body to output plural aligned modulated image data, and generating plural block dimming signals based on the plural block dimming data included in the plural modulated image data;

a data driving circuit part for generating a data voltage corresponding to the aligned modulated image data supplied from the timing controller, and supplying the data voltage to the liquid crystal display panel, according to data control signals supplied from the timing controller;

a gate driving circuit part for generating a scan pulse according to gate control signals supplied from the timing controller, and supplying the scan pulse to the liquid crystal display panel;

a backlight unit for emitting light to the plural display blocks; and a backlight driver for driving the backlight unit based on the plural block dimming signals.

2. The image display device according to claim 1, wherein the system main body replaces the lowermost bit of the plural image data corresponding to a bit number of the block dimming data among the plural image data supplied to the first horizontal line in each of the plural display blocks with the plural block dimming data.

3. The image display device according to claim 1, wherein the system main body replaces the lowermost bit of the plural image data corresponding to a bit number of the block dimming data among the plural image data supplied to the first horizontal line in each of the plural display blocks with the plural block dimming data, which is applied block-by-block, so as to include scanning data for sequentially driving the backlight unit according to the sequential driving of the horizontal rows of the plural display blocks.

4. The image display device according to claim 3, wherein the timing controller extracts the plural block dimming data or the plural scanning data together with the plural block dimming data from the modulated image data, and generates plural block dimming signals based on the plural block dimming data or the plural scanning data together with the plural block dimming data.

5. The image display device according to claim 4, wherein the backlight driver generates plural block dimming voltages corresponding to each of the plural block dimming signals supplied from the timing controller; and drives the backlight unit to apply light to the plural display blocks according to the generated each of the plural block dimming voltages.

6. The image display device according to claim 5, wherein the backlight unit includes plural LED arrays which are arranged to confront the plural display blocks, and are respectively driven according to the each of the plural block dimming voltages supplied from the backlight driver.

7. An image display device comprising:

a liquid crystal display panel with plural display blocks;

a timing controller for aligning plural modulated image data supplied from a system main body to output plural aligned modulated image data, and generating plural block dimming signals based on plural block dimming data included in plural image data supplied from the system main body;

a data driving circuit part for generating a data voltage corresponding to the aligned modulated image data supplied from the timing controller, and supplying the data voltage to the liquid crystal display panel, according to data control signals supplied from the timing controller;

a gate driving circuit part for generating a scan pulse according to gate control signals supplied from the timing controller, and supplying the scan pulse to the liquid crystal display panel;

a backlight unit for emitting light to the plural display blocks; and a backlight driver for driving the backlight unit based on the plural block dimming signals;

wherein the plural image data are modulated to include the plural block dimming data as the lowermost bit of the plural image data by replacing the lowermost bit of the plural image data with the block dimming data, in the system main body, to output the plural modulated image data including the plural image data and the plural block dimming data.

8. The image display device according to claim 7, wherein the timing controller extracts the plural block dimming data or the plural scanning data together with the plural block dimming data from plural modulated image data supplied from the system main body, and generates plural block dimming signals based on the plural block dimming data or the plural scanning data together with the plural block dimming data.

9. The image display device according to claim 8, wherein the backlight driver generates plural block dimming voltages corresponding to each of the plural block dimming signals supplied from the timing controller; and drives the backlight unit to apply light to the plural display blocks according to the generated each of the plural block dimming voltages.

10. The image display device according to claim 9, wherein the backlight unit includes plural LED arrays which are arranged to confront the plural display blocks, and are respectively driven according to the each of the plural block dimming voltages supplied from the backlight driver.

11. An image display device comprising:

a system main body for controlling a transmittance of light applied to plural display blocks of the image display device from a backlight unit, wherein the system main body generates plural image data, analyzes block image data supplied to the plural display blocks, generates plural block dimming data for controlling the backlight unit, modulates the plural image data to include the plural block dimming data as the lowermost bit of the plural image data by replacing the lowermost bit of the plural image data with the block dimming data, to output plural modulated image data including the plural image data and the plural block dimming data;

a timing controller for aligning the plural modulated image data supplied from the system main body to output plural aligned modulated image data, and generating plural block dimming signals based on the plural block dimming data; and a data driving circuit part for generating a data voltage corresponding to the aligned modulated image data supplied from the timing controller, and supplying the data voltage to the liquid crystal display panel.

12. The image display device according to claim 11, wherein the system main body replaces the lowermost bit of the plural image data corresponding to a bit number of the block dimming data among the plural image data supplied to the plural display blocks with the plural block dimming data; and supplies the image data including the modulated plural block dimming data to the timing controller.

13. A method of driving an image display device including a liquid crystal display panel with plural display blocks, and a backlight unit for emitting light to the plural display blocks, comprising:

generating plural image data, and generating plural block dimming data by analyzing the plural image data supplied to the plural display blocks, in a system main body;

modulating the plural image data to include the plural block dimming data as the lowermost bit of the plural image data by replacing the lowermost bit of the plural image data with the block dimming data, in the system main body, and outputting plural modulated image data including the plural image data and the plural block dimming data;

aligning the plural modulated image data supplied to output plural aligned modulated image data, and generating plural block dimming signals based on the plural block dimming data included in the plural modulated image data; and irradiating the plural display blocks with light emitted from the backlight unit which is driven based on the plural block dimming data included in the plural modulated image data supplied from the system main body, and displaying an image based on the plural aligned modulated image data supplied from the system main body on the liquid crystal display panel.

14. The method according to claim 13, wherein the modulating the plural image data includes:

replacing the lowermost bit of the plural image data corresponding to a bit number of the block dimming data among the plural image data supplied to the first horizontal line in each of the plural display blocks with the plural block dimming data.

15. The method according to claim 13, wherein the irradiating the plural display blocks with light emitted from the backlight unit includes:

extracting the plural block dimming data from the plural modulated image data supplied from the system main body;

generating plural block dimming signals, which is applied block-by-block, according to the extracted plural block dimming data;

generating plural block dimming voltages corresponding to each of the plural block dimming signals, wherein the plural block dimming voltage are applied block-by-block; and irradiating the plural display blocks with light by driving the plural LED arrays respectively arranged to confront the plural display blocks according to each of the plural block dimming voltages.

* * * * *